US007341030B2

(12) United States Patent
Hori et al.

(10) Patent No.: US 7,341,030 B2
(45) Date of Patent: Mar. 11, 2008

(54) VALVE TIMING CONTROLLER

(75) Inventors: Akira Hori, Kariya (JP); Eiji Isobe, Kariya (JP); Yoshihito Moriya, Nagoya (JP); Takashi Inoue, Toyota (JP); Koichi Shimizu, Toyota (JP)

(73) Assignees: Denso Corporation, Kariya, Aichi-pref. (JP); Toyota Jidosha Kabushiki Kaisha, Toyota, Aichi-pref. (JP)

( * ) Notice: Subject to any disclaimer, the term of this patent is extended or adjusted under 35 U.S.C. 154(b) by 0 days.

(21) Appl. No.: 11/712,553

(22) Filed: Mar. 1, 2007

(65) Prior Publication Data

US 2007/0204822 A1 Sep. 6, 2007

(30) Foreign Application Priority Data

Mar. 1, 2006 (JP) ..... 2006-055082

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | |
|---|---|---|---|
| 6,883,482 | B2 | 4/2005 | Takenaka et al. |
| 7,100,556 | B2 | 9/2006 | Sugiura |
| 2005/0061277 | A1 * | 3/2005 | Takenaka et al. ..... 123/90.17 |

* cited by examiner

*Primary Examiner*—Zelalem Eshete
(74) *Attorney, Agent, or Firm*—Nixon & Vanderhye P.C.

(57) ABSTRACT

A valve timing controller is provided with a first rotary element that rotates in response to the movement of a crankshaft, a second rotary element that rotates in response to the movement of a camshaft. A link mechanism changes a relative rotation phase between the first and second rotary elements. The first and second rotary elements include introduction passages that introduce a lubricating fluid in the first rotary element. In the link mechanism, shafts are fitted in the links. The links relatively rotate with respect to the shaft, and include conveying passages to communicate with the introduction passages and convey the lubricating fluid from the introduction passages to the circumference of the shaft.

8 Claims, 11 Drawing Sheets

VALVE TIMING CONTROLLER

CROSS-REFERENCE TO RELATED APPLICATION

This application is based on Japanese Patent Application No. 2006-55082 filed on Mar. 01, 2006, the disclosure of which is in incorporated herein by reference.

FIELD OF THE INVENTION

The present invention relates to a valve timing controller of an internal combustion engine that adjusts valve opening/closing timing of at least one of an intake valve and an exhaust valve by a camshaft with torque transmission from a crankshaft.

BACKGROUND OF THE INVENTION

A valve timing controller includes a first rotary element rotating in response to one of a crankshaft and a camshaft and a second rotary element rotating in response to the other of the crankshaft and the camshaft. The controller changes a relative rotation phase between the rotary elements by a link mechanism to adjust valve timing.

Specifically, in a device disclosed in JP-2005-48707A (U.S. Pat. No. 6,883,482 B2), a link mechanism that is constituted by combining a first link linked to a first rotary element and a second link linked to a second rotary element and the first link is provided in the first rotary element. Here, the first link is linked to the first rotary element by a revolute pair via a shaft fitted therein and the second link is linked to the second rotary element and the first link by a revolute pair via the shaft fitted therein.

In general, a valve timing controller is operated in response to momentarily changing operational states of an internal combustion engine, and therefore, the operation frequency thereof is higher. Because of that, in the device disclosed in JP-2005-48707A, when each link of a link mechanism is relatively rotated with respect to the shaft, there is a concern that wear is generated in an interface between each link and the shaft, so that the durability is deteriorated. Then, a method to introduce a lubricating fluid into the first rotary element receiving the link mechanism for reducing wear can be considered, but only with the introduction of the lubricating fluid into the rotary element, it is difficult to provide the lubricating fluid to a pinpoint, that is, the interface between each link and the shaft in the link mechanism of which the operation frequency is higher.

SUMMARY OF THE INVENTION

The present invention is made from this problem, and an object of the invention is to provide a valve timing controller with higher durability.

According to an aspect of the present invention, in a link mechanism received in a first rotary element, a conveying passage of a link in which a shaft is fitted communicates with an introduction passage to introduce a lubricating fluid into the first rotary element. Hence, even when the link mechanism has higher operation frequency, the lubricating fluid can be conveyed from the introduction passage to the circumference of the shaft by the conveying passage, and also the lubricating fluid conveyed to the circumference of the shaft can flow into an interface between the link and the shaft to lubricate the interface. Therefore, wear in the interface between the link and the shaft can be reduced and the durability of the link mechanism can be improved.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION OF EMBODIMENTS

Embodiments of the invention will be hereinafter described with reference to the drawings. Components identical to those in each embodiment are referred to as identical numerals and the same explanation is not repeated.

First Embodiment

Figure 2:
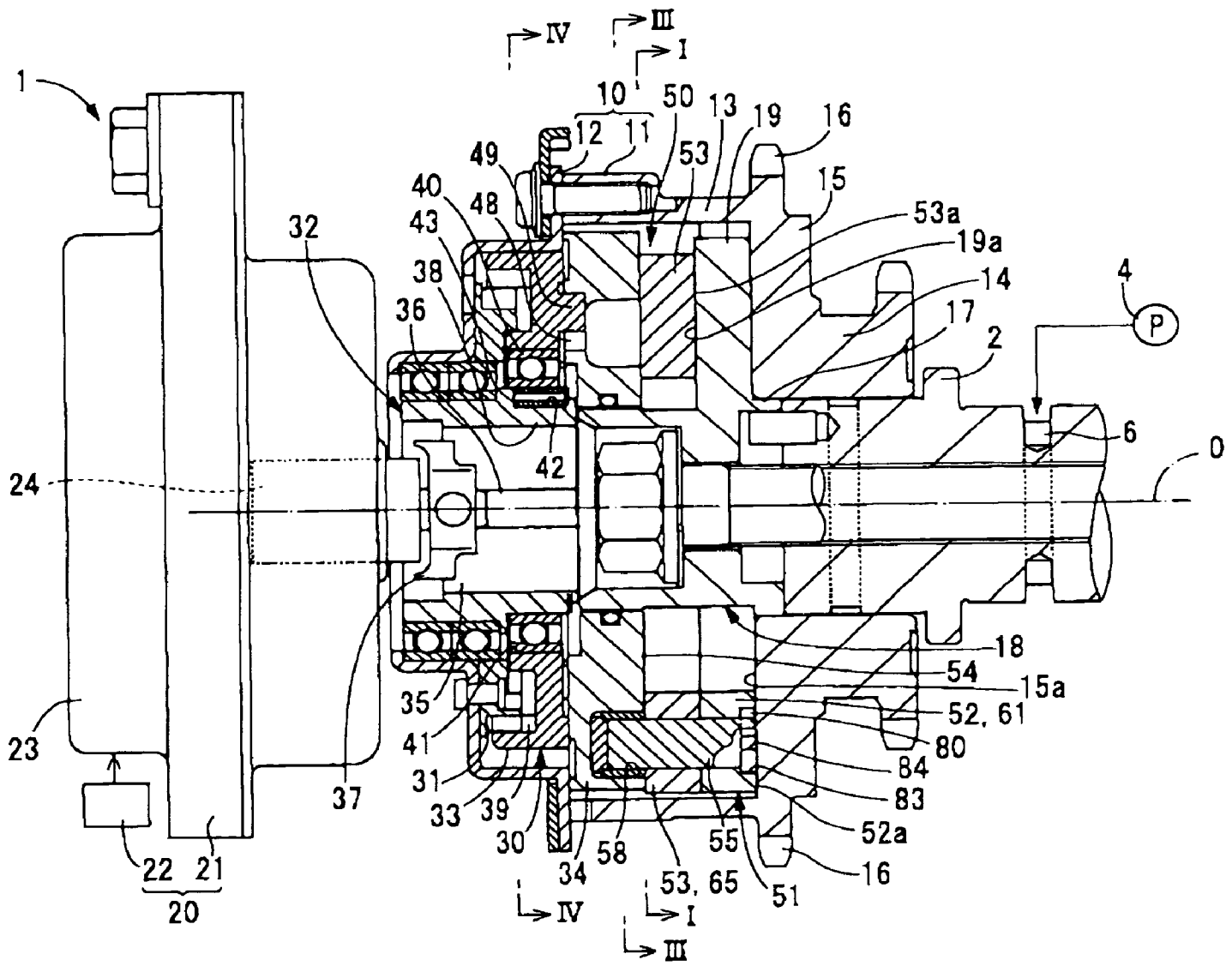
FIG. 2 is a cross-sectional view taken along a line II-II of FIG. 1.

FIG. 2 shows a valve timing controller 1 according to a first embodiment of the present invention. The valve timing controller 1 is provided in a transmission system which transmits engine torque from a crankshaft to a camshaft 2 of an internal combustion engine. The valve timing controller 1 changes a relative rotation phase between the crankshaft and the camshaft 2 to adjust valve timing of an intake valve.

The valve timing controller 1 includes a driving rotary element 10 (a first rotary element), a driven rotary element 18 (a second rotary element), a control unit 20, a differential gear mechanism 30 and a phase change mechanism 50.

Figure 1:
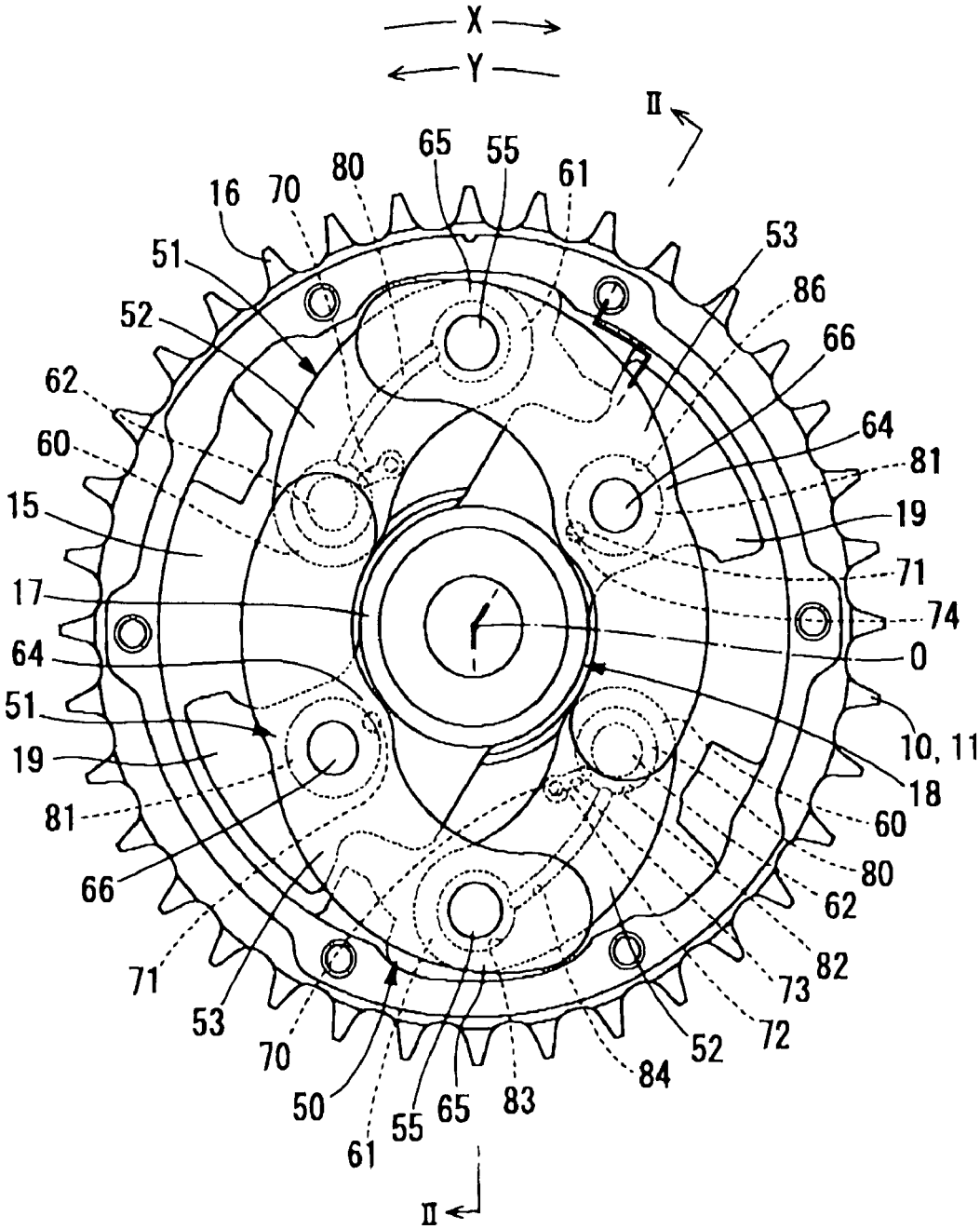
FIG. 1 is a cross-sectional view taken along a line I-I of FIG. 2 showing a valve timing controller according to a first embodiment of the present invention.
Figure 3:
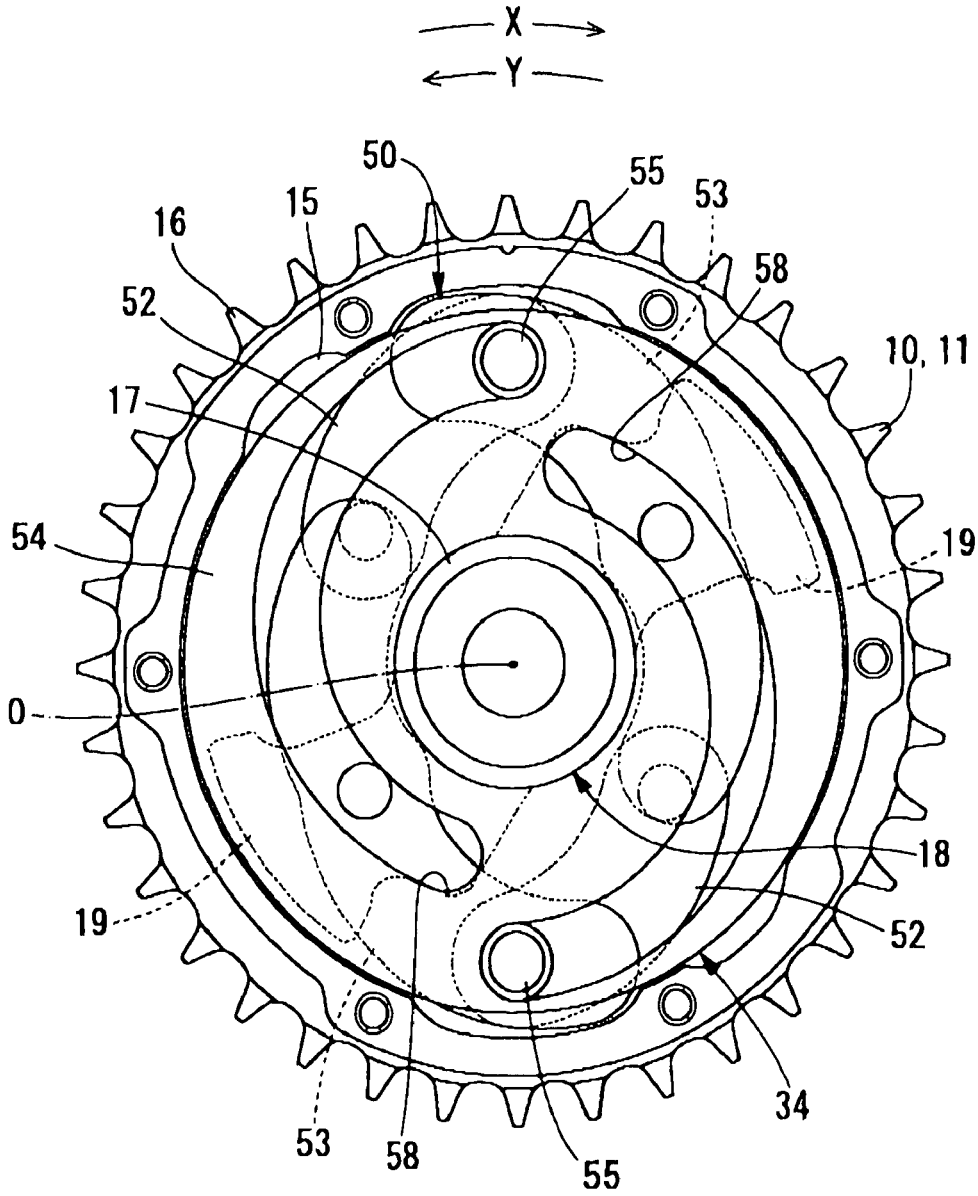
FIG. 3 is a cross-sectional view taken along a line III-III of FIG. 2.

As shown in FIGS. 1 to 3, the driving rotary element 10 is formed in a hollow shape as a whole and receives the differential gear mechanism 30, the phase change mechanism 50 and the like. The driving rotary element 10 includes a two-step cylindrical shaped sprocket 11 and a two-step cylindrical shaped cover 12. A larger diameter side end portion of the two-step cylindrical shaped sprocket 11 and a larger diameter side end portion of the two-step cylindrical shaped cover 12 are coaxially fixedly screwed.

The sprocket 11 includes a larger diameter part 13, a smaller diameter part 14, a connection part 15 to connect between the larger diameter part 13 and the smaller diameter part 14 and a plurality of teeth 16 formed in the connection part. The teeth 16 are formed in a manner that the teeth project to an outer peripheral side thereof and a circular timing chain is wound between the teeth 16 and a plurality of teeth of the crankshaft. Thus, when engine torque outputted from the crankshaft is transmitted to the sprocket 11 through the timing chain, the driving rotary element 10 rotates around a rotational axis "O" in response to the movement of the crankshaft while maintaining a relative rotation phase with respect to the crankshaft. At the time, a rotational direction of the driving rotary element 10 is clockwise in FIGS. 1 and 3.

As shown in FIGS. 1 and 2, the driven rotary element 18 includes a shaft 17 and a pair of linkage sections 19. The shaft 17 is formed in a cylindrical shape and positioned coaxially with the driving rotary element 10 and the camshaft 2. An end portion of the shaft 17 is slidably and rotatably fitted in the inner peripheral side of the connection part 15 of the sprocket 11 and also bolted to an end portion of the camshaft 2. Because of that, the driven rotary element 18 is rotatable around the rotational axis "O" in response to the movement of the camshaft 2, while maintaining a relative rotation phase with respect to the camshaft 2, and also, the driven rotary element 18 is relatively rotatable with respect to the driving rotary element 10. A relative rotational direction in which the driven rotary element 18 rotates to an advanced side with respect to the driving rotary element 10 is referred to as a direction "X", and a relative rotational direction in which the driven rotary element 18 rotates to a retarded side with respect to the driving rotary element 10 is referred to as a direction "Y".

Each of the linkage sections 19 is formed in a flat plate shape to project radially outwardly from an intermediate part of the shaft 17 and disposed respectively at a 180 degree rotation symmetrical position relative to the rotational axis "O".

As shown in FIG. 2, the control unit 20 is composed of an electric motor 21, an energization control circuit 22 and the like. The electric motor 21 is, for instance, a brushless motor or the like and includes a motor case 23 that is fixed to the internal combustion engine through a stay (not shown) and a motor shaft 24 that is supported rotatably in normal and reverse directions by the motor case 23. The energization control circuit 22 is an electrical circuit such as a microcomputer and is disposed outside or inside the motor case 23 to be electrically connected with the electric motor 21. The energization control circuit 22 controls energization to a coil (not shown) of the electric motor 21 in accordance with an operational state of the internal combustion engine or the like. With the energization control, the electric motor 21 forms a rotating magnetic field around the motor shaft 24 and generates rotational torque in the direction. "X" or "Y" (refer to FIG. 4) corresponding to a direction of the rotating magnetic field to the motor shaft 24.

Figure 4:
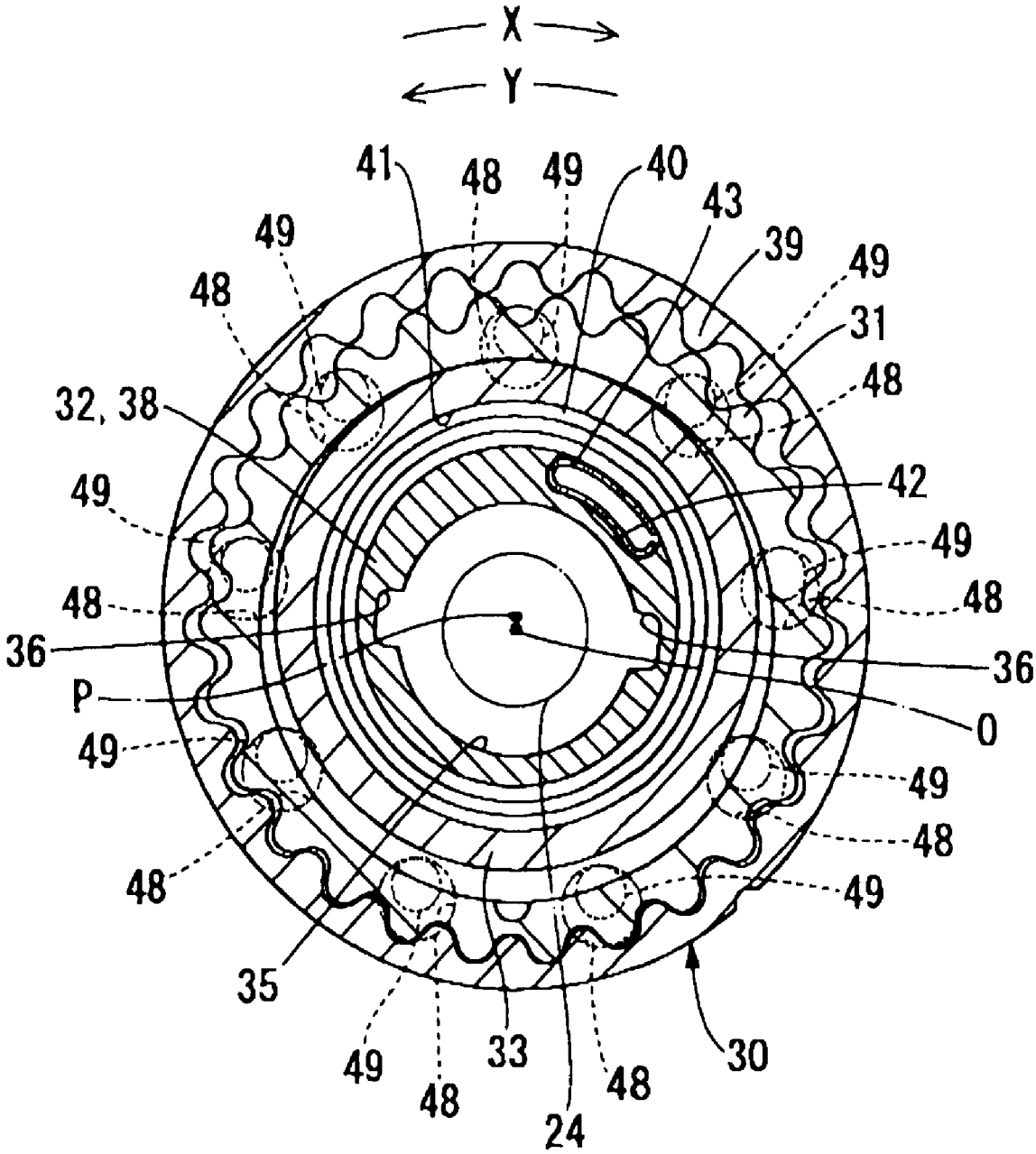
FIG. 4 is a cross-sectional view taken along a line of IV-IV of FIG. 2.

As shown in FIGS. 2 and 4, the differential gear mechanism 30 is formed of an external gear 31, a planetary carrier 32, an internal gear 33 and a guide rotary element 34.

The external gear 31 includes a tip circle and a root circle formed at the outer peripheral side of the tip circle. The external gear 31 is riveted coaxially with the cover 12 to possibly rotate integrally with the driving rotary element 10.

The planetary carrier 32 is formed in a tubular shape as a whole and includes an inner peripheral surface 35 formed in a cylindrical surface shape coaxially with the driving rotary element 10. In the inner peripheral surface 35 of the planetary carrier 32, a groove 36 is opened. By a joint 37 fitted into the groove 36, the motor shaft 24 is fixed to the planetary carrier 32 coaxially with the inner peripheral surface 35. With such fixation, the planetary carrier 32 can rotate around the rotational axis "O" in response to the movement of the motor shaft 24 and also can relatively rotate with respect to the driving rotary element 10. The planetary carrier 32 further includes an eccentric cam part 38 provided at the other side of the motor shaft 24, and the eccentric cam part 38 includes an outer peripheral surface of a cylindrical surface shape to be off-centered with respect to the driving rotary element 10.

The internal gear 33 is formed in a bottomed cylindrical shape and is provided with a gear part 39. The gear part 39 includes a tip circle and a root circle formed at the inner peripheral side of the tip circle. The root circle of the gear part 39 is larger than the tip circle of the external gear 31. Moreover, the number of teeth of the gear part 39 is larger than the number of teeth of the external gear 31 by one tooth. The gear part 39 is disposed at the outer peripheral side of the external gear 31, off-centered with respect to the rotational axis "O", and is meshed with the external gear 31 on the other side of the eccentric side.

A center hole 41 of the internal gear 33 has a cylindrical bore shape coaxially with the gear part 39 and is fitted into the outer peripheral side of the eccentric cam part 38 via a bearing 40. The internal gear 33 is supported by the planetary carrier 32 and can achieve a planetary motion to revolve in the rotational direction of the eccentric cam part 38, rotating around an eccentric centerline "P" of the outer peripheral surface of the eccentric cam part 38. In the first embodiment, a receiving hole 42 opens into the outer peripheral surface of the eccentric cam part 3B and receives a U-shaped leaf spring 43 therein. The leaf spring 43 presses an inner peripheral surface of the center hole 41 of the internal gear 33 via the bearing 40. Thus, the internal gear 33 is tightly meshed with the external gear 31.

As shown in FIGS. 2 and 3, the guide rotary element 34 is formed in an annular ring plate shape coaxially with the driving rotary element 10. The guide rotary element 34 is slidably and rotatably fitted into an outer peripheral side of an end portion of the shaft 17 of the driven rotary element 18 at the opposite side of the camshaft 2. The guide rotary element 34 is rotatable around the rotational axis "O" and also relatively rotatable with respect to the rotary elements 10, 18. As shown in FIGS. 2 and 4, the guide rotary element 34 includes engaging holes 48 which are formed at nine spots equally spaced in the rotational direction. In addition, corresponding to the above holes, the internal gear 3 includes engaging projections 49. Each columnar engaging projection 49 projects into and engages with each corresponding engaging hole 48.

In the differential gear mechanism 30 with the configuration as described above, when the planetary carrier 32 does not relatively rotate with respect to the driving rotary element 10, the internal gear 33 rotates with the driving rotary element 10 without any planetary motion. Each engaging projection 49 presses each engaging hole 48 to the rotating side. As a result of that, the guide rotary element 34 rotates clockwise in FIG. 4, while maintaining a relative rotation phase between the guide rotary element 34 and the driving rotary element 10.

When the planetary carrier 32 relatively rotates in the direction "X" with respect to the driving rotary element 10 by the electric motor 21, the internal gear 33 performs a planetary motion while changing the meshing teeth between the internal gear 33 and the external gear 31. Therefore, the force with which each engaging projection 49 presses each engaging hole 48 to the rotating side is increased. As a result of that, the guide rotary element 34 relatively rotates in the direction "X" with respect to the driving rotary element 10.

When the planetary carrier 32 relatively rotates in the direction "Y" with respect to the driving rotary element 10 by the electric motor 21 or an abnormal stop of the electric motor 21 during the operating of the engine, the internal gear 33 performs a planetary motion while changing the meshing teeth between the internal gear 33 and the external gear 31. Thereby, each engaging projection 49 presses each engaging hole 48 to the reverse rotating side. As a result of that, the guide rotary element 34 relatively rotates in the direction "Y" with respect to the driving rotary element 10.

As described above, because of the relative rotational movement of the planetary carrier 32 with respect to the driving rotary element 10, the internal gear 33 performs a planetary motion and the planetary motion is transmitted to the guide rotary element 34. Thus, the guide rotary element 34 relatively rotates with respect to the driving rotary element 10.

Figure 5:
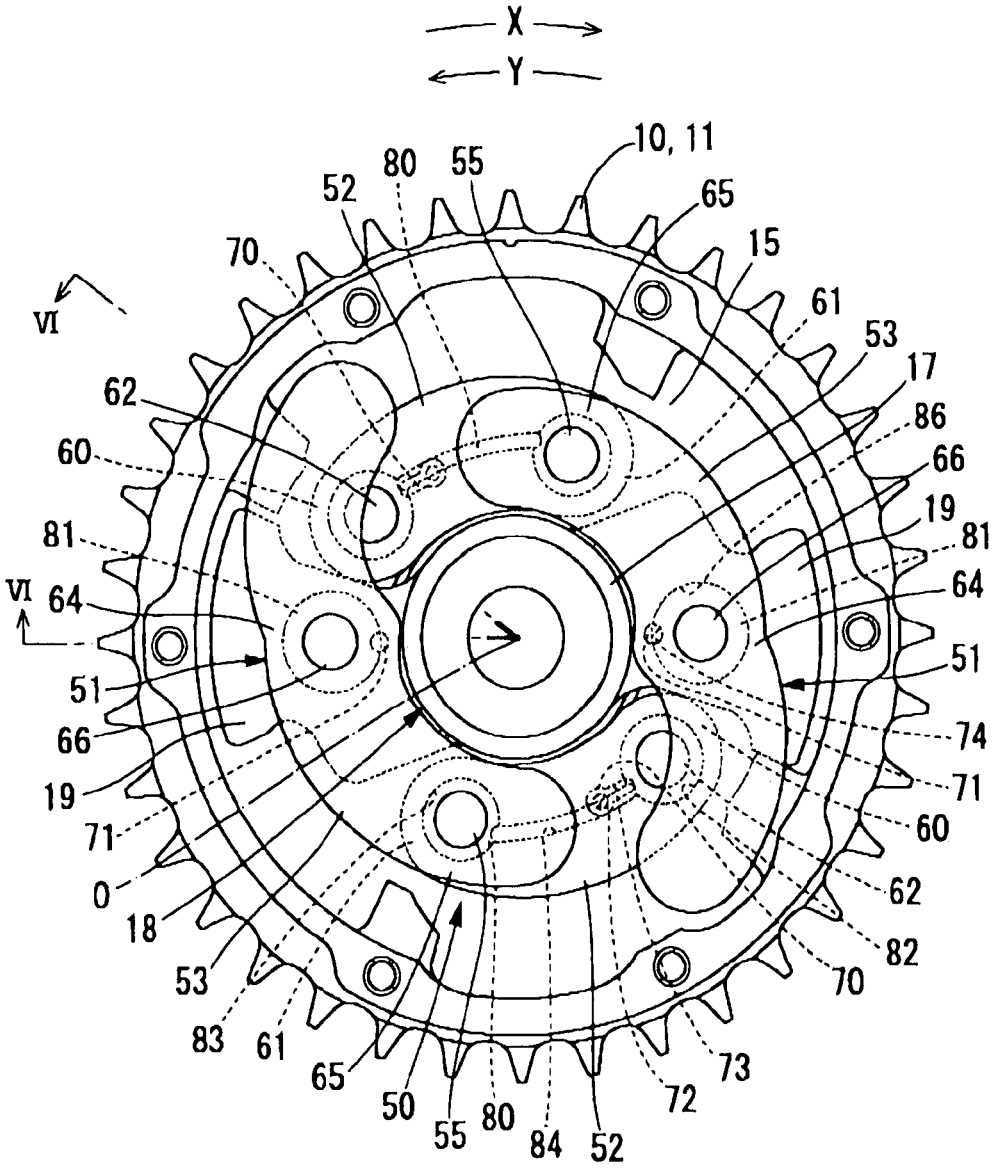
FIG. 5 is a cross-sectional view showing an operating condition different from that in FIG. 1.
Figure 6:
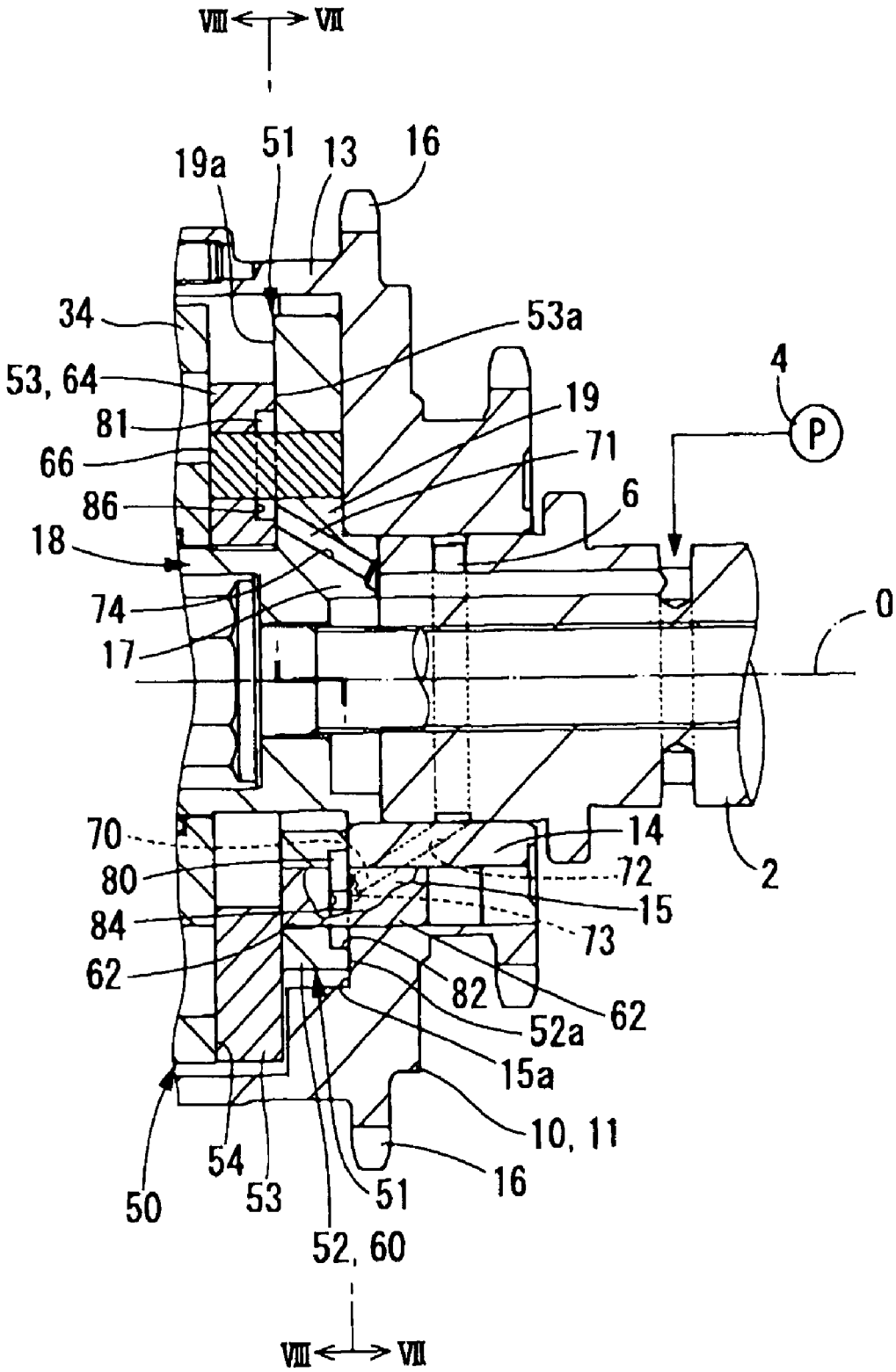
FIG. 6 is a cross-sectional view taken along a line of VI-VI of FIG. 5.

As shown in FIGS. 1 to 3 and FIGS. 5 and 6, the phase change mechanism 50 includes two groups of link mechanisms 51, a groove forming part 54 and a pair of movable shafts 55. Each of FIGS. 1 to 3 shows a state of the phase change mechanism 50 when the driven rotary element 18 rotates to the most retarded side with respect to the driving rotary element 10, and each of FIGS. 5 and 6 shows a state of the phase change mechanism 50 when the driven rotary element 18 rotates to the most advanced side with respect to the driving rotary element 10. Further, in each of FIGS. 1, 3 and 5, hatching for showing a cross section is omitted.

As shown in FIGS. 1 and 2, each group of the link mechanisms 51 is composed of a combination of two kinds of links 52 and 53 and disposed respectively at a 180 degree rotation symmetrical position relative to the rotational axis "O".

The first link 52 of the link mechanism part 51 in each group is formed in a flat plate shape to be extended in an arc shape and includes pairing elements 60 and 61 at both end portions thereof. Here, in the pairing element 61, a movable shaft 55 (a second shaft) which is press-fitted and fixed to the second link 53 of the link mechanism part 51 in the same group is relatively rotatably fitted. Thus, the first link 52 is linked to the second link 53 of the link mechanism part 51 in the same group by a revolute pair via the movable shaft 55. Moreover, as shown in FIGS. 5 and 6, in the pairing element 60, a shaft 62 (a first shaft) which is press-fitted and fixed to the connection part 15 and supported by the driving rotary element 10 is relatively rotatably fitted. Thus, the first link 52 is linked to the driving rotary element 10 by a revolute pair via the shaft 62. The movement of the revolute pair is achieved in a manner that a sidewall surface 52*a* of the first link 52 is in sliding contact with an inner wall surface 15*a* of the connection part 15.

As shown in FIGS. 1 and 2, the second link 53 of the link mechanism part 51 in each group is formed in a flat plate shape to be extended in ω-shape and includes pairing elements 64 and 65 in the intermediate part. Here, in the pairing element 65, the movable shaft 55 for forming the revolute pair between the link 52 and the link 53 of the link mechanism part 51 in the same group as mentioned above is press-fitted and fixed. As shown in FIGS. 5 and 6, in the pairing element 64, a shaft 66 which is press fitted and fixed to the corresponding linkage section 19 and supported by the driven rotary element 18 is relatively rotatably fitted. Thus, the second link 53 is linked to the driven rotary element 18 by a revolute pair via the shaft 66. The movement of the revolute pair is achieved in a manner that a sidewall surface 53*a* of the second link 53 is in sliding contact with a sidewall surface 19*a* of the linkage section 19.

As shown in FIGS. 2 and 3, the groove forming part 54 is formed by a portion including a wall surface on the opposite side of the internal gear 33 in the guide rotary element 34. In the groove forming part 54, each of guide grooves 58 is formed at a 180 degree rotation symmetrical position relative to the rotational axis "O". Each guide groove 58 extends with a predetermined width at an outer peripheral side of the rotational axis "O" and has a curved shape to be inclined relative to a radial axis of the guide rotary element 34 such that the distance thereof from the rotational axis "O" changes in the extending direction. Each guide groove 58 in the first embodiment is inclined, as shown in FIG. 3, such that the more each guide groove 58 moves in the direction "X", the further each guide groove 58 is separated from the rotational axis "O". Alternatively, each guide groove 58 may be inclined such that the more each guide groove 58 moves in the direction "Y", the further each guide groove 58 is separated from the rotational axis "O". In addition, each guide groove 58 may be formed in any other shapes such as a linear shape, besides the curbed shape as shown in FIG. 3.

As shown in FIGS. 1 to 3, each movable shaft 55 is formed into a cylindrical shaft to be off-centered relative to the rotational axis "O". One end portion of each movable shaft 55 is slidably fitted into each corresponding guide groove 58. The other end portion of each movable shaft 55 is relatively rotatably fitted into the pairing element 61 of the first link 52 constituting the corresponding group of the link mechanisms 51. The intermediate part of each movable shaft 55 is press fitted and fixed to the pairing element 65 of the second link 53 constituting the corresponding group of the link mechanisms 51.

In the phase change mechanism 50 with the configuration as described above, when the guide rotary element 34 maintains the relative rotation phase between the guide rotary element 34 and the driving rotary element 10, each movable shaft 55 is not guided in the guide groove 58 but rotates with the guide rotary element 34. At this time, in each group of the link mechanisms 51, a relative positional relationship between the link 52 and the link 53 is not changed. Therefore, the driven rotary element 18 rotates clockwise in FIG. 3 while maintaining a relative rotation phase between the driven rotary element 18 and the driving rotary element 10. The relative rotation phase of the camshaft 2 with respect to the crankshaft, that is, the valve timing is maintained.

When the guide rotary element 34 relatively rotates in the direction "X" with respect to the driving rotary element 10, each movable shaft 55 slides in such a manner that each movable shaft 55 approaches the rotational axis "O" in each guide groove 58. At this time, each movable shaft 55 rotationally drives the first link 52 of the corresponding group of the link mechanisms 51 with the shaft 62 serving as a fulcrum, and simultaneously is displaced to decrease the distance between each movable shaft 55 and the rotational axis "O". As a result of that, the second link 53 of each group of the link mechanisms 51 is pressed by each movable shaft 55 to be driven with each linkage section 19 in the direction "X". Therefore, the driven rotary element 18 rotates to the advanced side with respect to the driving rotary element 10, and at the same time, the valve timing is advanced.

When the guide rotary element 34 relatively rotates in the direction "Y" with respect to the driving rotary element 10, each movable shaft 55 slides in such a manner that each movable shaft 55 is apart from the rotational axis "O" in each guide groove 58. At this time, each movable shaft 55 rotationally drives the first link 52 of the corresponding group of the link mechanisms 51 with the shaft 62 serving as a fulcrum, and simultaneously is displaced to increase the distance between each movable shaft 55 and the rotational axis "O". As a result of that, the second link 53 of each group of the link mechanisms 51 is pulled by each movable shaft 55 to be driven with each linkage section 19 in the direction "Y". Therefore, the driven rotary element 18 rotates to the retarded side with respect to the driving rotary element 10, and at the same time, the valve timing is retarded.

As described above, each movable shaft 55 drives the links 52 and 53 of each group of the link mechanisms 51 while being displaced in accordance with the relative rotational movement of the guide rotary element 34 with respect to the driving rotary element 10. Thereby, the relative rotation phase between the rotary element 10 and the rotary element 18, that is, the valve timing is changed.

In the following, characteristics of the rotary bodies 10 and 18 and the link mechanisms 51 according to the first embodiment will be explained with reference to FIGS. 1, 2, and FIGS. 5 to 8. In each of FIGS. 7 and 8, as in the case of FIGS. 1 and 5, hatching for showing a cross section is omitted.

Figure 7:
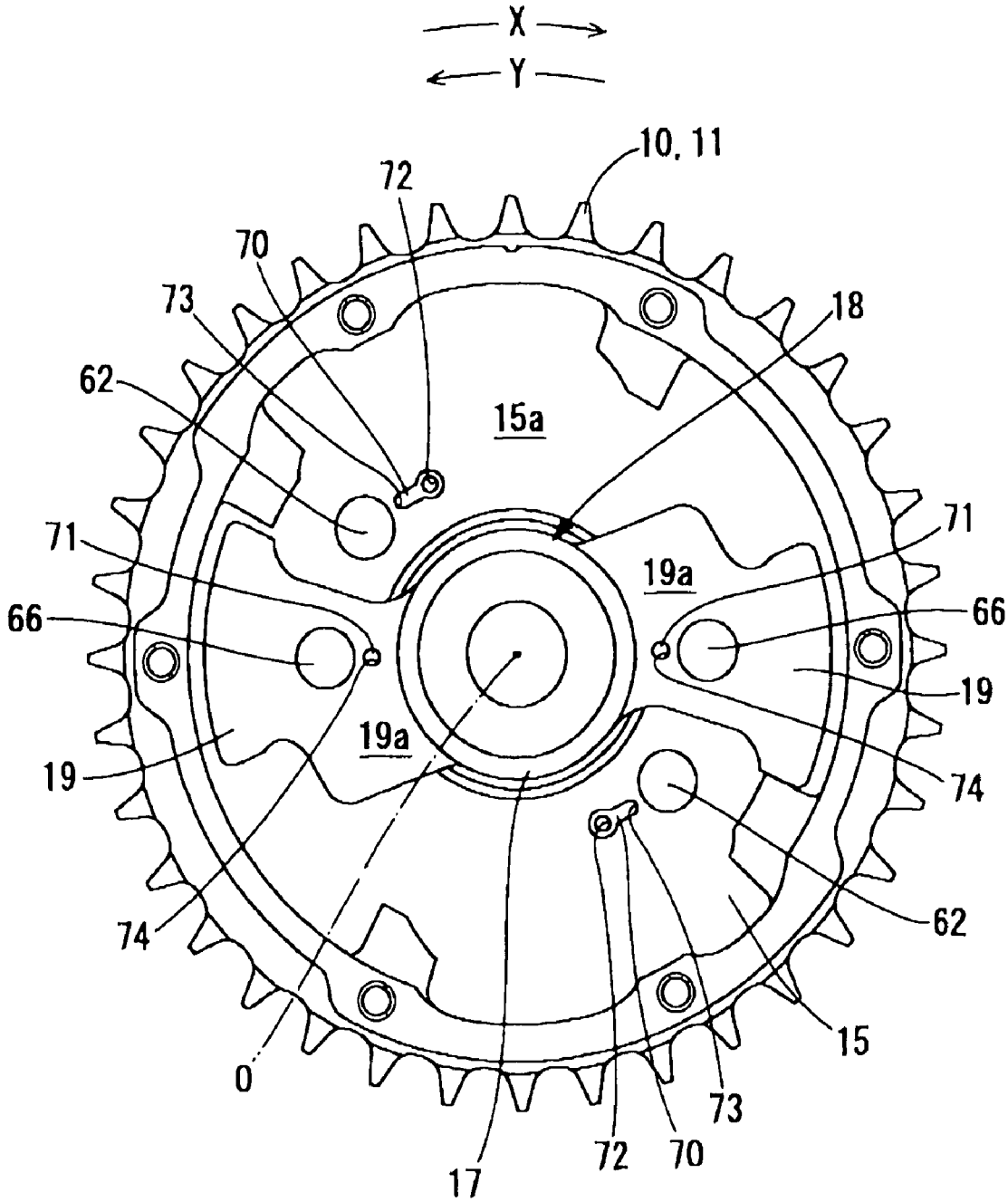
FIG. 7 is a cross-sectional view taken along a line of VII-VII of FIG. 6.

As shown in FIGS. 6 and 7, the sprocket 11 of the driving rotary element 10 includes a first introduction passage 70 to introduce lubricating oil into the driving rotary element 10. Specifically, in the sprocket 11, each of the first introduction passages 70 is provided at a 180 degree rotation symmetrical position relative to the rotational axis "O". Each first introduction passage 70 is formed inside of an introduction hole 72 and an introduction groove 73. Each passage 70 communicates with a supply passage 6 through which the lubricating oil is supplied from a pump 4 for the internal combustion engine. Here, the introduction hole 72 penetrates through the smaller diameter part 14 and connection part 15 of the sprocket 11 obliquely relative to the rotational axis "O". Moreover, the introduction groove 73 connected to the introduction hole 72 opens into the inner wall surface 15*a* of the connection part 15 and extends from the connection side with the introduction hole 72 to the circumference of the shaft 62. As shown in FIGS. 1, 5 and 6, in an arbitrary operating condition of the link mechanisms 51 (hereinafter simply referred to as an arbitrary operating condition), a part of opening of the introduction groove 73 is covered by the sidewall surface 52*a* of the corresponding first link 52.

As shown in FIGS. 6 and 7, the driven rotary element 18 includes a second introduction passage 71 to introduce the lubricating oil into the driving rotary element 10. Concretely, each of the second introduction passages 71 is provided at a 180 degree rotation symmetrical position relative to the rotational axis "O" in the driven rotary element 18. Each second introduction passage 71 is formed inside of an introduction hole 74, and communicates with the supply passage 6 of the camshaft 2. Here, the introduction hole 74 penetrates through the shaft 17 of the driven rotary element 18 and the corresponding linkage section 19 obliquely relative to the rotational axis "O". One end portion of the introduction hole 74 opens into the sidewall surface 19*a* of the linkage section 19. As shown in FIGS. 1, 5 and 6, in the arbitrary operating condition, a part of opening of the introduction hole 74 is covered by the sidewall surface 53*a* of the corresponding second link 53.

Figure 8:
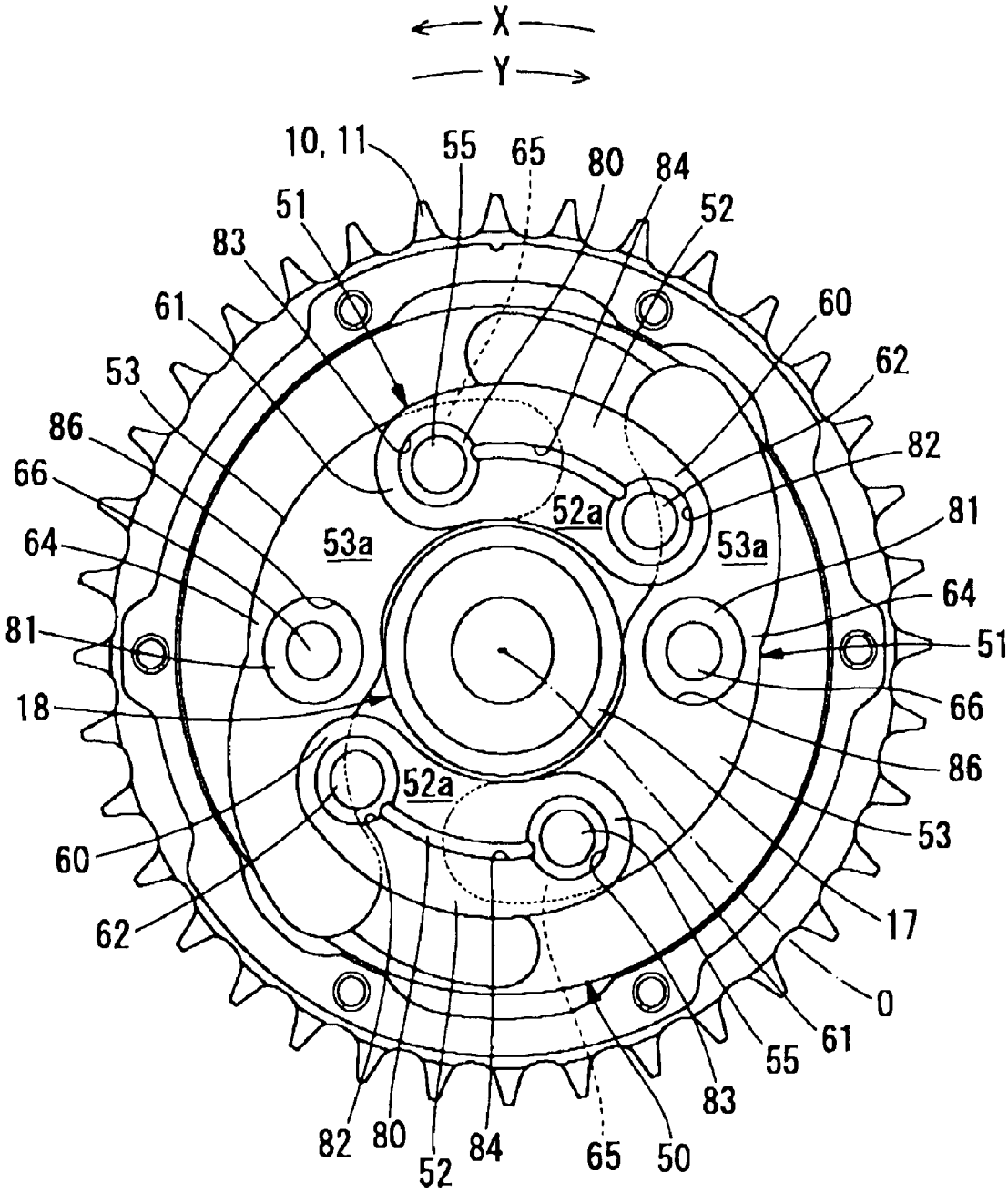
FIG. 8 is a cross-sectional view taken along a line of VIII-VIII of FIG. 6.

As shown in FIGS. 2, 6 and 8, the first link 52 of each group of the link mechanisms 51 includes a first conveying passage 80 to convey the lubricating oil to the circumference of each of the shaft 62 and the movable shaft 55 which are fitted therein. Specifically, the first conveying passage 80 is formed inside of conveying recesses 82, 83 and a conveying groove 84. The passage 80 communicates with the corresponding first introduction passage 70. Here, the conveying recess 82 is formed in an annular shape to surround the circumference of the shaft 62 in the pairing element 60 of the first link 52 and opens into the sidewall surface 52*a* of the first link 52. Further, the conveying recess 83 is formed in an annular shape to surround the circumference of the movable shaft 55 in the pairing element 61 of the first link 52 and opens into the sidewall surface 52*a*.

Furthermore, the conveying groove 84 is formed in an arc shape to connect the conveying recess 82 and the conveying recess 83 in the first link 52 and opens into the sidewall surface 52*a*. As shown in FIGS. 1, 5, and 6, in any operating condition, a part of opening of the conveying recess 82 faces a part of opening of the corresponding introduction groove 73 with each other. In any operating condition, the rest of opening of the conveying recess 82 is covered by the inner wall surface 15*a* of the connection part 15. On the other hand, as shown in FIGS. 1, 2 and 5, in any operating condition, the opening of the conveying recess 83 is completely covered by the inner wall surface 15*a* of the connection part 15. Moreover, except a specific operating condition of the link mechanism part 51, as shown in FIGS. 1 and 2, the opening of the conveying groove 84 is completely covered by the inner wall surface 15*a* of the connection part 15. Additionally, in the specific operating condition as shown in FIGS. 5 and 6, the opening of the conveying groove 84 partially faces the opening of each of the corresponding introduction hole 72 and introduction groove 73 with each other.

As shown in FIGS. 6 and 8, the second link 53 of each group of the link mechanisms 51 includes a second conveying passage 81 to convey the lubricating oil to the circumference of the shaft 66 which is fitted into the second link 53. Particularly, the second conveying passage 81 is formed inside of a conveying recess 86 and communicates with the corresponding second introduction passage 71. Here, the conveying recess 86 is formed in an annular shape to surround the circumference of the shaft 66 in the pairing element 64 of the second link 53 and opens into the sidewall surface 53*a* of the second link 53. As shown in FIGS. 1, 5 and 6, in any operating condition, a part of opening of the conveying recess 88 faces the corresponding introduction hole 74 with each other, and moreover, in any operating condition, the rest of opening of the conveying recess 86 is covered by the sidewall surface 19*a* of the corresponding linkage section 19.

According to the first embodiment, in each group of the link mechanisms 51, the opening of the conveying recess 82 faces the opening of the corresponding introduction groove 73 in any operating condition with each other. The first conveying passage 80 in the conveying recess 82 constantly communicates with the first introduction passage 70 in the corresponding groove 73. In other words, the first conveying passage 80 constantly communicates with the first introduction passage 70 at the circumference of the shaft 62 where the conveying recess 82 is provided. In each group of the link mechanisms 51, the lubricating oil supplied to the first introduction passage 70 through the supply passage 6 is conveyed to the circumference of the shaft 62 through the first conveying passage 80 in the conveying recess 82. Further, in each group of the link mechanisms 51, the lubricating oil is conveyed from the circumference of the shaft 62 to the circumference of the movable shaft 55 through the first conveying passage 80 in the conveying groove 84 and the conveying recess 83. The lubricating oil conveyed to the circumference of each of the shaft 62 and the movable shaft 55 as described above flows in an interface between each of the shaft bodies 62 and 55 and the first link 52 to possibly reduce wear in the interface and therefore, the durability can be improved.

In addition, according to the first embodiment, in each group of the link mechanisms 51, the opening of the conveying recess 86 faces the opening of the corresponding introduction hole 74 in any operating condition with each other. Therefore, the second conveying passage 81 in the conveying recess 86 constantly communicates with the second introduction passage 71 in the corresponding hole 74. That is, the second conveying passage 81 constantly communicates with the second introduction passage 71 at the circumference of the shaft 66 where the conveying recess 86 is provided. Consequently, in each group of the link mechanisms 51, the lubricating oil supplied to the second introduction passage 71 is conveyed to the circumference of the shaft 66 through the second conveying passage 81 in the conveying recess 86. The lubricating oil conveyed to the circumference of the shaft 66 flows in an interface between the shaft 66 and the second link 53 to possibly reduce wear in the interface and therefore, the durability can be improved.

Second Embodiment

Figure 9:
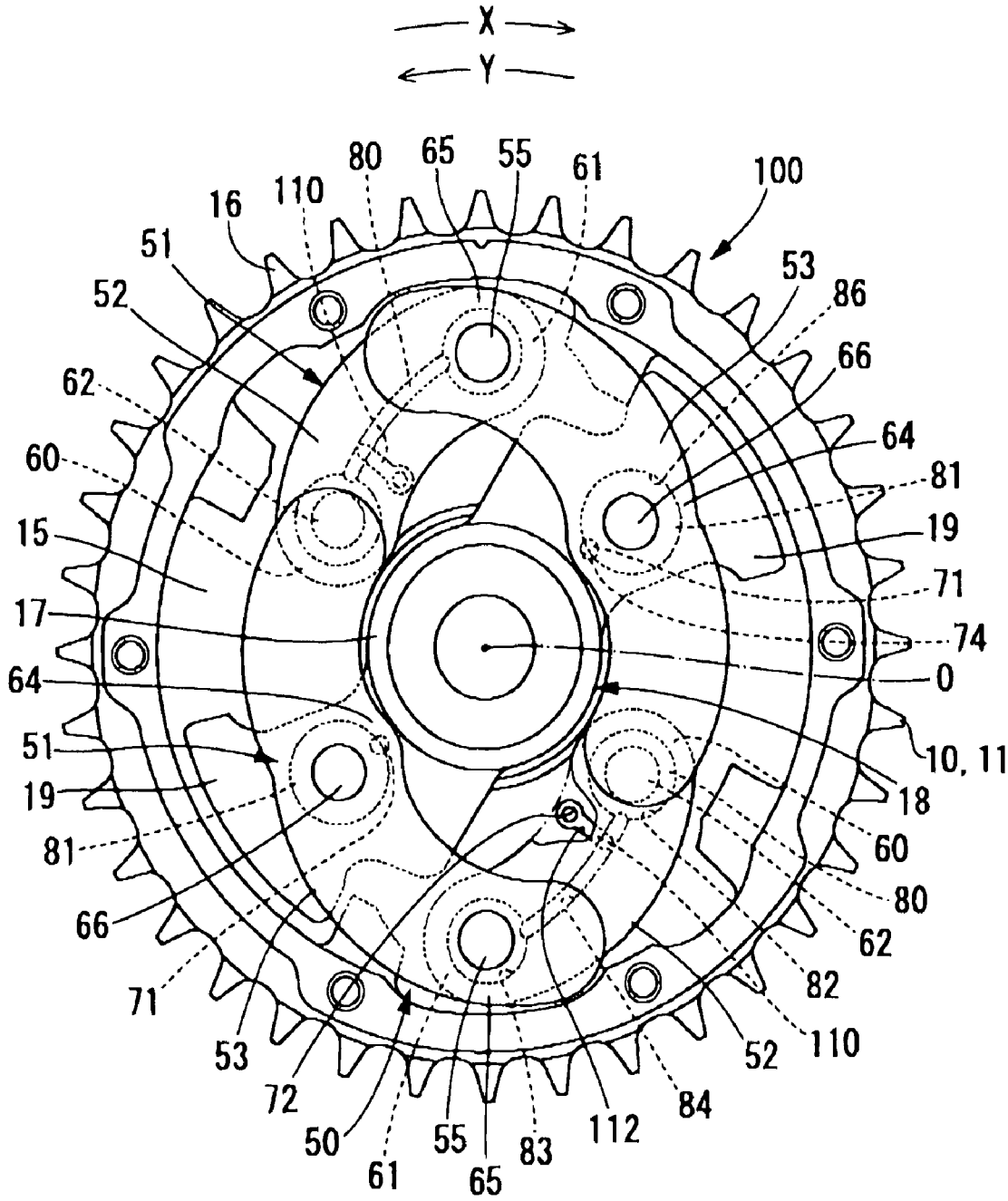
FIG. 9 is a cross-sectional view corresponding to FIG. 1 showing a valve timing controller according to a second embodiment of the present invention.
Figure 10:
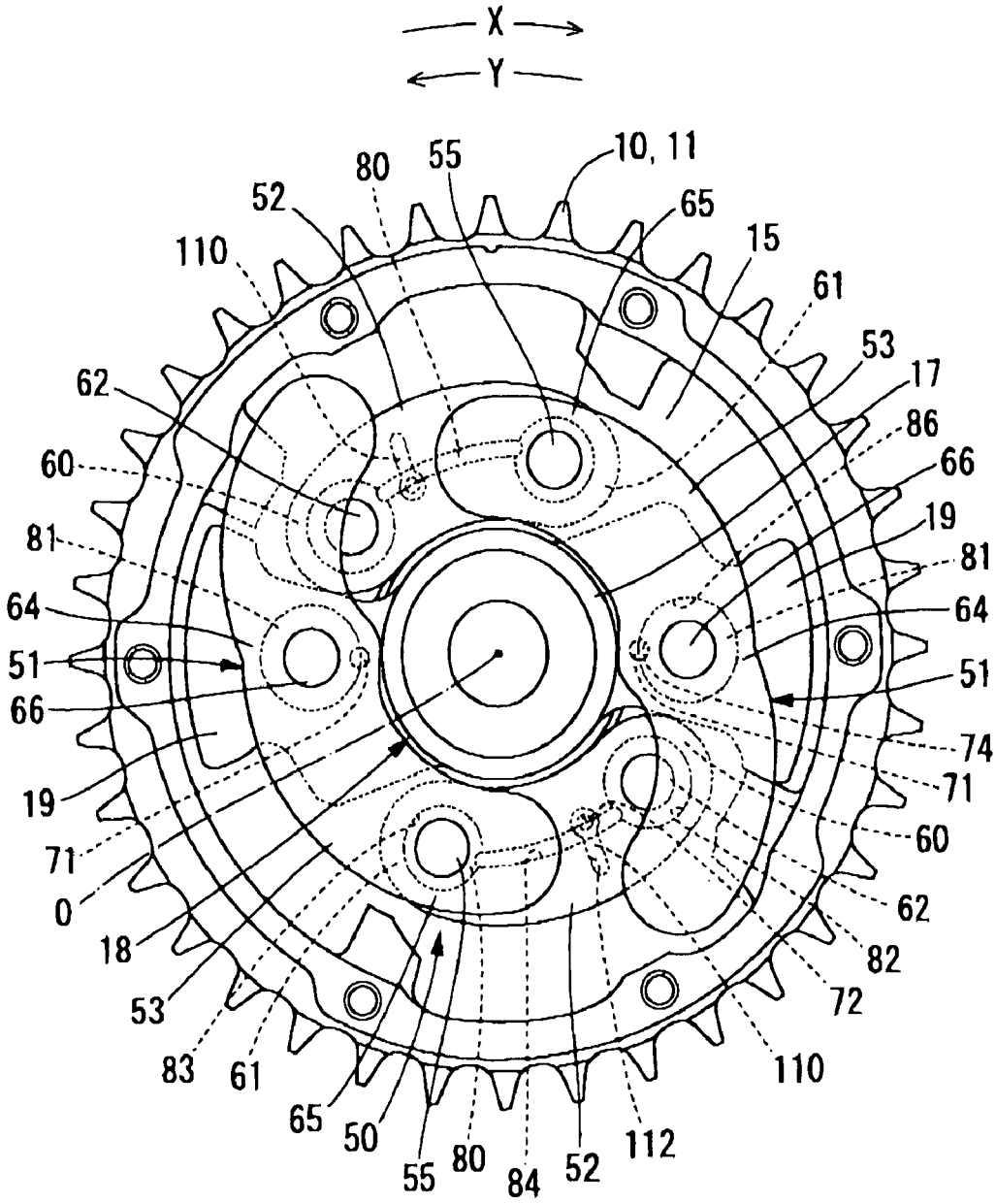
FIG. 10 is a cross-sectional view showing an operating condition different from that in FIG. 9.

A valve timing controller 100 according to a second embodiment of the present invention is shown in FIGS. 9 and 10. In FIGS. 9 and 10, hatching for showing a cross section is omitted.

In the second embodiment, a part of opening of each introduction groove 112 forming each first introduction passage 110 is provided to face a part of opening of the conveying groove 64 of the corresponding link 52 with each other in any operating condition. In each group of the link mechanisms 51, the first conveying passage 80 in the conveying groove 84 constantly communicates with the first introduction passage 110 in the corresponding introduction groove 112. In other words, the first conveying passage 80 constantly communicates with the first introduction passage 110 between the conveying recess 82 at the circumference of the shaft 62 and the conveying recess 83 at the circumference of the movable shaft 55. Thereby, in each group of the link mechanisms 51, the lubricating oil supplied to the first introduction passage 110 is distributed and conveyed through the first conveying passage 80 to the circumference of each of the shaft 62 and the movable shaft 55. Because of that, clean lubricating oil introduced from the first introduction passage 110 can be flown in an interface between the first link 52 and the shaft 62 and simultaneously an interface between the first link 52 and the movable shaft 55, which therefore can prevent a lubricating condition from being different between the interfaces.

As described above, a plurality of embodiments according to the present invention have been described, but the present invention is not intended to be limited to the embodiments and can also be applied to various sorts of embodiments in the scope of the present invention without departing from the gist thereof.

For instance, in the first link 52, depending on the distance between the shaft 62 and the shaft 55, the conveying groove 84 as in the first embodiment may not be provided, and the conveying recess 82 and the conveying recess 83 may be directly connected with each other.

Further, similar to the conveying groove 84 in each of the first and second embodiments, a conveying groove connected to the conveying recess 86 may be provided to the second link 53, and the opening of the conveying groove in the second link 53 may face the introduction hole 74 of the driven rotary element 18 with each other.

Still further, similar to the introduction groove 73 in each of the first and second embodiments, an introduction groove connected to the introduction hole 74 may be provided to the driven rotary element 18, and the opening of the introduction groove in the rotary element 18 may face the conveying recess 86 of the second link 53 or the conveying groove of the second link 53 described above as a modification.

Furthermore, the conveying passages 80 and 81 may be formed, for instance, inside of a hole that penetrates through each of the links 52 and 53, besides being formed respectively in each of the recesses 82, 83 and 86 and the groove 84 covered by each of the wall surfaces 15*a* and 19*a* as in the first and second embodiments.

In addition, contrary to the case of the first and second embodiments, the rotary element 10 may be rotated in response to the movement of the camshaft 2 and the rotary element 18 may be rotated in response to the movement of the crankshaft.

Figure 11:
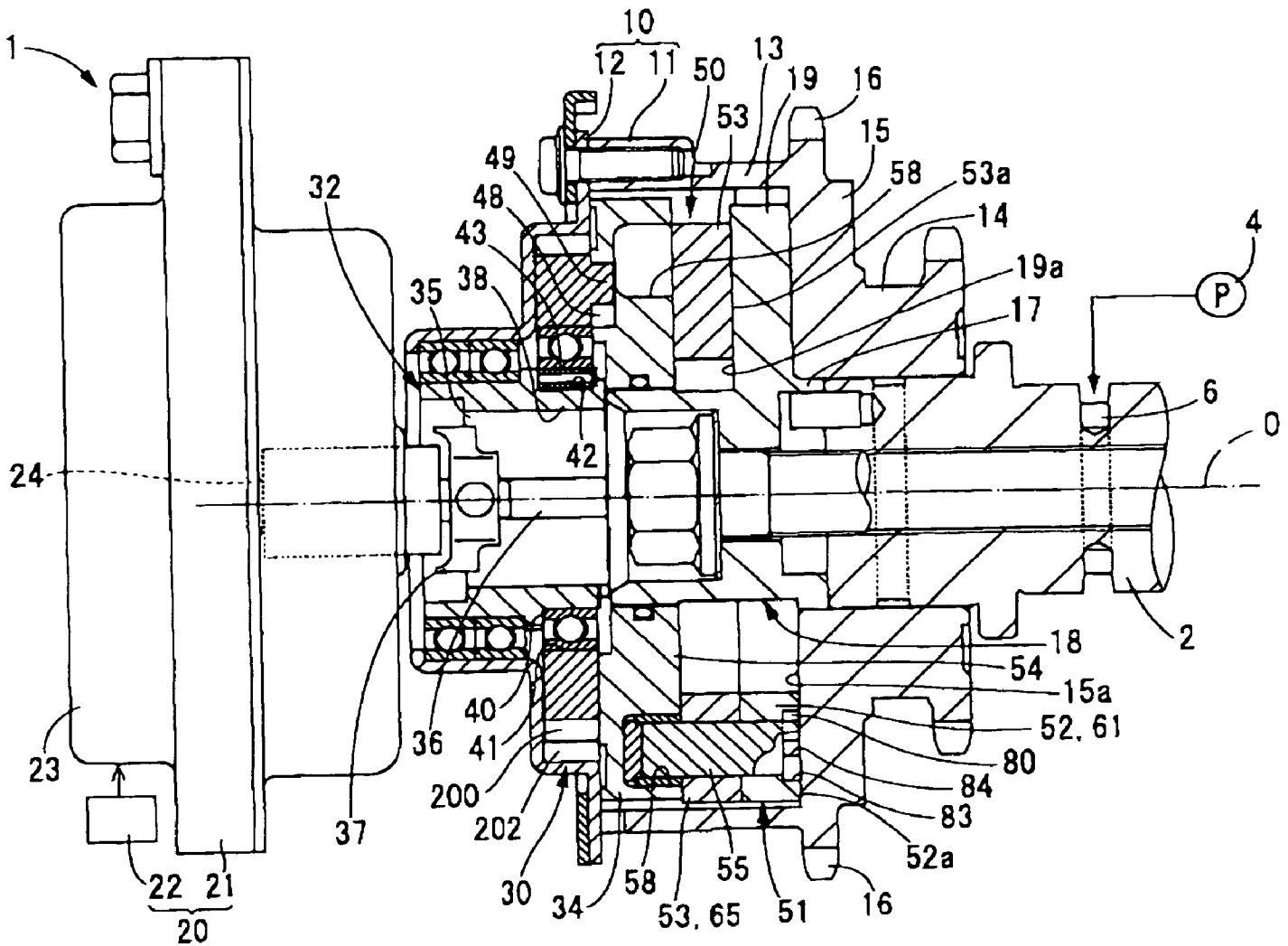
FIG. 11 is a cross-sectional view showing a modification.

Additionally, as shown in FIG. 11, an external gear 200 including the engaging projection 49 and supported by the planetary carrier 32 may be provided instead of the internal gear 33 according to the first and second embodiments. At the same time, an internal gear 202 to be meshed with the external gear 200 may be provided to the rotary element 10 instead of the external gear 31 according to the first and second embodiments.

Further additionally, instead of the electric motor 21 according to the first and second embodiments, an electromagnetic brake device, a hydraulic motor or the like which includes a brake member to rotate by the transmission of crankshaft driving torque and a solenoid to magnetically attract the brake member and produces braking torque generated in the brake member magnetically attracted by the solenoid as rotational torque may be used.

Still furthermore, the invention may be applied to a device to adjust the valve timing of an exhaust valve or a device to adjust the valve timing of both the intake valve and the exhaust valve.

What is claimed is:

1. A valve timing controller of an internal combustion engine that adjusts valve opening/closing timing of at least one of an intake valve and an exhaust valve by a camshaft with torque transmission from a crankshaft, comprising:

a first rotary element rotating in response to the movement of one of the crankshaft and the camshaft;

a second rotary element rotating in response to the movement of the other of the crankshaft and the camshaft; and a link mechanism including a link in which a shaft is fitted, and being received in the first rotary element to change a relative rotation phase between the first rotary element and the second rotary element, wherein at least one of the first rotary element and the second rotary element includes an introduction passage to introduce a lubricating fluid into the first rotary element, which is represented as a specific rotary element, the link relatively rotates with respect to the shaft, and includes a conveying passage communicated with the introduction passage to convey the lubricating fluid from the introduction passage to the circumference of the shaft.

2. A valve timing controller according to claim 1, wherein the link includes a slide contact surface in sliding contact with a wall surface of the specific rotary element, a conveying recess provided at the circumference of the shaft to open to the slide contact surface, and a conveying groove connected with the conveying recess to open to the slide contact surface; and the conveying passage is formed in the conveying recess and the conveying groove of which openings in the slide contact surface are covered by the wall surface.

3. A valve timing controller according to claim 2, wherein the specific rotary element includes an introduction groove which opens to the wall surface and faces at least one of the conveying recess and the conveying groove; and the introduction passage is formed in the introduction groove of which opening in the wall surface is covered by the slide contact surface.

4. A valve timing controller according to claim 1, wherein the link includes a slide contact surface in sliding contact with a wall surface of the specific rotary element and a conveying recess provided at the circumference of the shaft to open into the slide contact surface; and the conveying passage is formed in the conveying recess of which opening in the slide contact surface is covered by the wall surface.

5. A valve timing controller according to claim 1, wherein the link mechanism includes a combination of a first link linked to the first rotary element as the specific rotary element by a revolute pair via a first shaft and a second link linked to the second rotary element by a revolute pair and linked to the first link by a revolute pair via a second shaft;

the first link includes the link in which each of the first shaft and the second shaft is fitted; and the conveying passage conveys the lubricating fluid to the circumference of each of the first shaft and the second shaft.

6. A valve timing controller according to claim 5, wherein the introduction passage is formed at the circumference of the first shaft supported by the first rotary element; and the conveying passage communicates with the introduction passage at the circumference of the first shaft.

7. A valve timing controller according to claim 5, wherein the conveying passage communicates with the introduction passage between the circumference of the first shaft and the circumference of the second shaft.

8. A valve timing controller according to claim 1, comprising a drive means for driving the link mechanism by use of rotational torque generated by an electric motor.

* * * * *